US005676569A

United States Patent [19]

Davis

[11] Patent Number: 5,676,569

[45] Date of Patent: Oct. 14, 1997

[54] HOLDER FOR SEVERAL ELECTRICAL CONNECTORS

[75] Inventor: Wayne Samuel Davis, Harrisburg, Pa.

[73] Assignee: The Whitaker Corporation, Wilmington, Del.

[21] Appl. No.: 690,410

[22] Filed: Jul. 25, 1996

[51] Int. Cl.[6] ..... H01K 13/514

[52] U.S. Cl. ..... 439/731; 439/609; 439/540.1

[58] Field of Search ..... 439/701, 731, 439/608, 607, 609, 557, 540.1

[56] References Cited

U.S. PATENT DOCUMENTS

| | | | |
|---|---|---|---|
| 4,756,695 | 7/1988 | Lane et al. | 439/76 |
| 4,781,615 | 11/1988 | Davis et al. | 439/395 |
| 4,822,297 | 4/1989 | Prince et al. | 439/731 |
| 5,007,856 | 4/1991 | Puerner | 439/452 |
| 5,123,859 | 6/1992 | Davis et al. | 439/405 |
| 5,161,997 | 11/1992 | Defibaugh et al. | 439/532 |
| 5,184,961 | 2/1993 | Ramirez et al. | 439/59 |
| 5,198,279 | 3/1993 | Beinhaur et al. | 428/99 |
| 5,314,357 | 5/1994 | Weidler | 439/731 |
| 5,376,011 | 12/1994 | Rudy et al. | 439/79 |
| 5,496,195 | 3/1996 | Reed | 439/607 |

FOREIGN PATENT DOCUMENTS

| | | | |
|---|---|---|---|
| DT2628617 | 1/1977 | Germany | 439/557 |

OTHER PUBLICATIONS

U.S. Patent Application Serial No. 08/511,199 filed Aug. 4, 1995 (Abstract and Drawings only included).

U.S. Patent Application Serial No. 08/601,636 Feb. 14, 1996 (Abstract and Drawings only included).

AMP Booklet 296065, Rev. D, "Connector System for the Universial Serial Bus", Dec. 1995; 27 pages; AMP Incorporated, Harrisburg, PA.

*Primary Examiner*—Gary F. Paumen

*Assistant Examiner*—Christopher Goins

*Attorney, Agent, or Firm*—Anton P. Ness

[57] ABSTRACT

Holder (60) formed by a pair of holder members 70,72 defining connector-receiving cavities (76) into inner surfaces (74) thereof, for connectors (12,14) to be held therein for manipulation as a unit. Cavities (76) include along bottom and side walls (90,86) relief or clearance apertures (88,92) to receive projections from outer surfaces of connectors (12,14). Holder members (70,72) self-secure to each other around portions of the connectors using fastening posts (80) and post-receiving holes (82) and may be hermaphroditic.

4 Claims, 2 Drawing Sheets

HOLDER FOR SEVERAL ELECTRICAL CONNECTORS

FIELD OF THE INVENTION

The present invention relates to the field of electrical connectors and more particularly to shielded connectors.

BACKGROUND OF THE INVENTION

Certain electrical connectors are known having an array of contacts disposed in a housing at a plug-receiving cavity, with the connector adapted to be mounted to a circuit board. A shell member is disposed around the connector for shielding against electromagnetic and radiofrequency interference (EMI/RFI). Such a connector is sold as a Universal Serial Bus receptacle connector having Part No. 95-8099-23-1 matable with a plug connector having Part No. 95-8083-19-1, both by AMP Incorporated, Harrisburg, Pa.

In U.S. patent application Ser. No. 08/601,636 filed Feb. 14, 1996 and assigned to the assignee hereof, there is disclosed an electrical connector, also board-mountable and defining a pair of plug-receiving cavities to enable simultaneous mating with a pair of complementary plug connectors. A shell member is disposed around the forward connector portion about the mating interface, and provides shielding of the mating interface at a panel cutout defining an input/output port of an electronic apparatus such as a computer. In this connector, a portion of the shielding is provided along the bottom wall but is insulated from circuitry of the circuit board beneath the connector by a bottom housing wall, since the shield wall portions are disposed within a horizontal slot of the housing beneath the plug-receiving cavities.

It is desired to use shielded connectors having single plug-receiving cavities in a side-by-side arrangement, thereby eliminating the need for manufacturing and maintaining an inventory of additional connectors.

SUMMARY OF THE INVENTION

The present invention provides a holder for securing together at least two shielded connectors each containing a single plug-receiving cavity, in a side-by-side relationship. The two shielded connectors may be different from each other, or they may be identical, such as connectors that are presently in commercial use, sold as Universal Serial Bus connectors having Part Nos. 787616-1 or 787616-2 by AMP Incorporated, Harrisburg, Pa.

The holder comprises a pair of opposed sections molded of insulative material and securable to each other about the connectors without requiring any modification to the connectors, and the holder assembly may be adapted for mounting to a circuit board such as at an input/output port of an electronic apparatus such as a computer. The sections may be hermaphroditic for reducing inventory of different parts and minimizing tooling costs. Preferably the sections include integral fastening means, thus further reducing costs and simplifying assembly, for self-securing to each other at at least two locations, with a plurality of locations being preferred in elongated versions of the holder.

Advantages of the present invention include providing insulation beneath the bottom shield walls of the connector, allowing the shields of the discrete connectors to include walls between the two connectors, reduction in height of the connector assembly, and handling and manipulation of the connectors as a unit to facilitate board-mounting.

An embodiment of the present invention will now be described by way of example with reference to the accompanying drawings.

DETAILED DESCRIPTION

Figure 1:
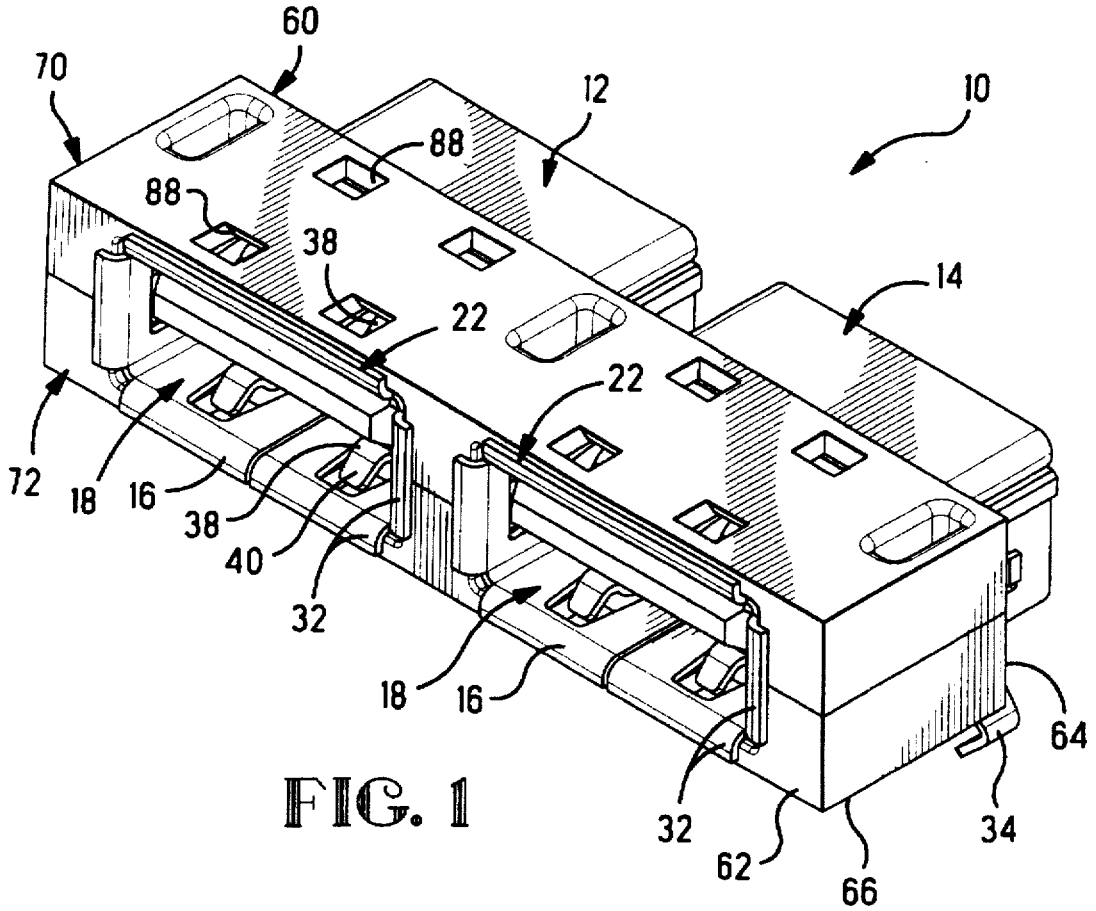
FIG. 1 is an isometric view of the holder of the present invention assembled to a pair of shielded connectors.

Connector assembly 10 in the FIGS. includes a pair of discrete receptacle connectors 12,14 mounted within a holder 60, with mating faces 16 of the connectors disposed along a common front side 62 of the holder. As shown, the holder preferably surrounds forward portions of the connectors. Each connector defines a plug-receiving cavity 18 extending rearwardly from the mating face 16 to be matable with a complementary plug connector (not shown). Contacts (FIG. 3) of the connectors include contact sections exposed within a plug-receiving cavity 18 and may further include solder tails 54 depending from a bottom face 20 of the connectors for insertion into and soldering within corresponding through-holes, or for surface mount soldering to corresponding pads, of a circuit board (nit shown), at the rearward connector portion rearwardly of a rear side 64 of holder 60.

Each connector 12,14 includes a shield member 22 having a top wall 24, bottom wall 26 and side walls 28 to be disposed about the insulative housing 30 and defining the plug-receiving cavity 18 thereof. Front edges of shield walls 24,26,28 preferably are formed to include short outwardly curved flanges 32 at the entrance to plug-receiving cavity 18 to effectively close the small gap remaining between the cavity entrance and the panel cutout periphery following mounting of connector 12,14 just inside the input/output port.

Shield member 22 is shown to include shell-engaging spring arms 34 extending from side walls 28 rearwardly and into the plug-receiving cavity to outwardly angled free ends 36 to engage an outer shield of a mating plug connector. Also seen are retention arms 38 extending from top and bottom walls 24,26 forwardly and into the plug-receiving cavity for embossed outwardly angled free ends 40 thereof to seat within recesses into outer surfaces of the plug connector upon mating, to retain the plug and receptacle connectors in mated engagement. Upon connector mating, free ends 36 of spring arms 34 will be deflected outwardly to protrude slightly beyond the remainder of side walls 28. During connector mating, free ends 40 of retention arms 38 will protrude outwardly beyond the remainder of top and bottom walls 24,26 until seated within the recesses of the mating plug connector.

Each shield 22 further includes a pair of board-mount legs 42 depending from the bottom or board-mounting face 20 of the connector, extending downwardly beyond the bottom side 66 of holder 60 for receipt into corresponding mounting holes of the circuit board. Shield 22 is shown to be securable to a housing 30 by a latch projection 44 of housing 30 seating within a recess 46 of each side wall 28 of the shield; a rib 48 is also shown extending outwardly through a slot 50 of each side wall 28 of shield 22 to assist in shield retention and to stabilize the orientation of the housing within the shield.

Holder 60 comprises a pair of holder members 70,72 and are shown to be hermaphroditic as is preferable. Each holder member defines an inner surface 74 to extend along and adjacent outer surface portions of the forward portion of shield 22 of each connector 12, defining half of a connector-receiving recess 76 to contain either the top shield wall 24 or the bottom shield wall 26, and half of each shield side wall 28 of a connector 12,14. Flanges 32 at forward edges of the shield walls 24,26,28 are disposed forwardly of front face 62 of holder 60 upon assembly. Holder 60 illustrates holder members 70,72 that are hermaphroditic, as is preferable; i.e., that two members are exactly alike and are adapted to cooperate to fasten together about the connectors. Embossments 78 are located between the two connector-receiving recesses 76 and at ends of the holder members.

Fastening posts 80 of each holder member extend beyond inner surface 74, and cooperate with post-receiving holes 82 of the opposed holder member in an interference fit when pressed together about the connectors, such that the holder members self-retain to each other thereafter to define the holder 60. As is preferable, holes 82 are hexagonal in cross-section, and the distance between opposed planar side wall sections is less than the diameter of fastening posts 80. Preferably deformable ribs 84 extend along side walls 86 of connector-receiving cavities 76 to absorb manufacturing tolerances and form a force-fit laterally with the connectors upon assembly for centering, while the holders are pressed together as closely as possible, which is tightly against the top and bottom shield walls 24,26 of the connectors.

The holders 70,72 are further adapted to complement connectors 12,14: apertures 88 are defined into bottom recess walls 90 to define clearances for receipt thereinto of free ends 40 of retention arms 38 of the receptacle connectors 12,14 during mating with complementary plug connectors (not shown) until fully seated into recesses of the plug connector; and niches 92 are defined into side recess walls 86 for receipt thereinto of free ends 28 of spring arms 26 during connector mating. Each holder has symmetrically disposed apertures 86 and niches 90 forwardly and rearwardly so that either holder may be utilized as the top of holder 60 or the bottom of holder 60, consistent with the preferred hermaphroditic nature thereof. Further, between forward and rearward ones of each pair of apertures 86 is preferably defined a shallow channel 94 to allow receipt thereinto of retention arms 38 spaced from free ends 40 thereof.

Figure 3:
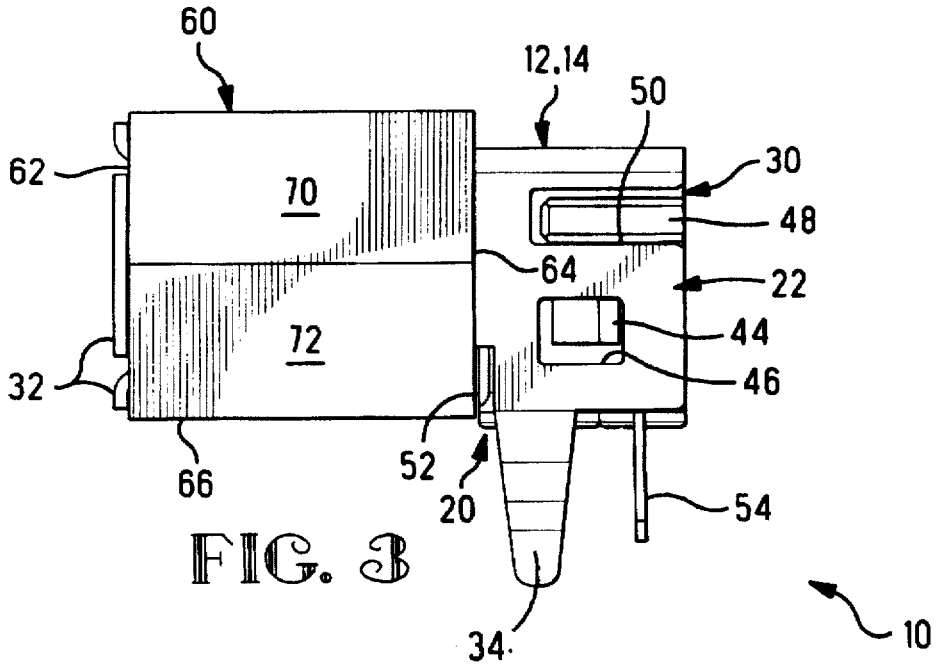
FIG. 3 is an elevation view of the assembled connector of FIG. 1.
Figure 2:
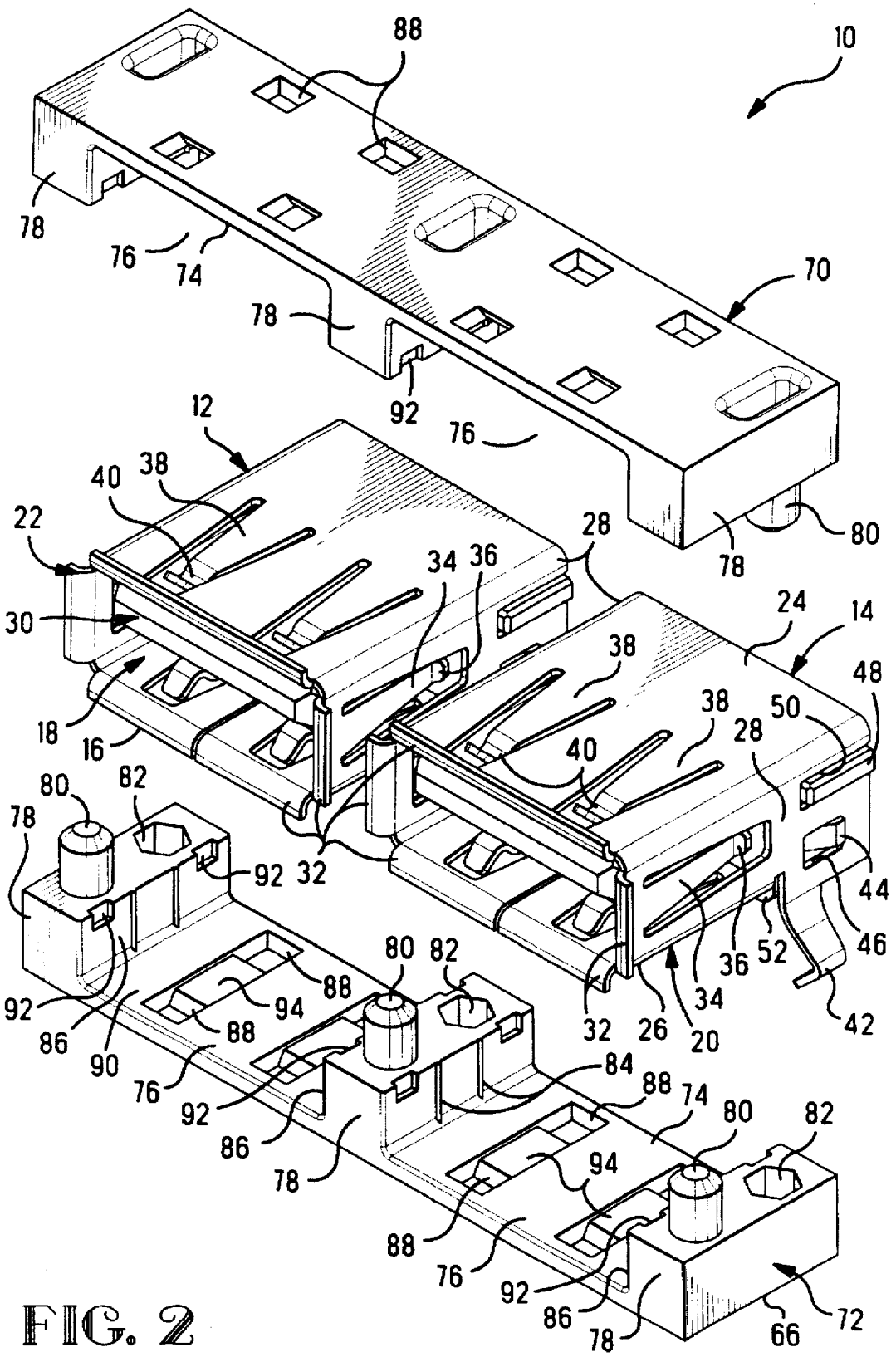
FIG. 2 is an isometric exploded view of the assembly of FIG. 1.

With reference to FIG. 3, connectors 12,14 are held in holder 60 against relative rearward movement by flanges 32 abutting front face 62 of the holder, while rear face 64 abuts housing 30 at stop surfaces defined by front surfaces 52 of a rearward portion of the housing extending lower than bottom shell wall 26. Solder tails 54 of the contacts of the connector are shown depending from the rearward connector portion for insertion into and soldering within through-holes of a circuit board. The connectors are held centered within respective cavities 76 by crushing of ribs 84 along opposed side walls 86 of each cavity, whereby holder 60 maintains the connectors in a known selected position aligned with holes of the circuit board to which the connectors are to be mounted.

The present invention provides a holder for at least one connector that is adapted to complement not only the size of the connector but also the structure of the connector, both in the unmated and mated conditions. The holder may contain several such connectors for convenience in handling and mounting a plurality of connectors simultaneously. If the connectors are identical, the holder members may be hermaphroditic. Additionally, the insulative material of the holder isolates the shields of the connectors from circuits of the circuit board to which the shields would otherwise be adjacent, allowing the circuit board to utilize the space beneath the connectors for circuits, if desired.

Variations and modifications to the embodiment disclosed herein, may be devised that are within the spirit of the invention and the scope of the claims.

What is claimed is:

1. A holder for holding at least one electrical connector, comprising:

a pair of holder members of insulative material together defining at least one connector-receiving cavity into opposed assembly faces thereof in communication with front and rear surfaces of said holder members, and embossments to both sides of said cavity containing cooperating fastening sections along said assembly faces, said fastening sections include posts extending from at least one said holder member to be received in force-fit into post-receiving holes of the other said holder member upon assembly about a said at least one connector for self-securing to each other, and surfaces of each said at least one connector-receiving cavity include pairs of apertures defining clearances for receipt thereinto of projections from outer surfaces of the corresponding connector, with apertures of each pair being aligned between said front and rear walls of said holder members and spaced equally therefrom, whereby the holder members are adapted to be fastened to each other surrounding a portion of a connector disposed in a respective said connector-receiving cavity and exposing opposed faces of the connector for electrical connection to other electrical articles, for holding the at least one connector for manipulation thereof.

2. The holder as set forth in claim 1 wherein side surfaces of each said at least one connector-receiving cavity includes deformable ribs along both cavity side walls adapted to be crushed by a corresponding said connector upon urging said holder members around said connector for assured centering of the connector in the respective cavity of the holder.

3. The holder as set forth in claim 1 wherein the holder members define at least two said connector-receiving cavities, to hold a corresponding at least two connectors therein.

4. The holder as set forth in claim 3 wherein each said holder member includes a plurality of said fastening posts and a like plurality of said post-receiving holes on each said embossment spaced like distances from said front and rear walls thereof and aligned therebetween, whereby the holder members may be hermaphroditic when the connectors and the connector-receiving cavities are identical in size and shape.

* * * * *